US005741064A

United States Patent [19]

Chin et al.

[11] Patent Number: 5,741,064

[45] Date of Patent: Apr. 21, 1998

[54] LIGHTING FIXTURE WITH A SOCKET BASE HAVING A CLOSED AND COOL RUNNING BACK

[75] Inventors: Michael E. Chin; Ann Greene, both of Cranford; Thomas Russello, Howell, all of N.J.

[73] Assignee: The Genlyte Group Incorporated, Seacucus, N.J.

[21] Appl. No.: 610,090

[22] Filed: Feb. 29, 1996

[51] Int. Cl.[6] ..... F21V 17/00

[52] U.S. Cl. ..... 362/448; 362/294; 362/363

[58] Field of Search ..... 362/294, 363, 362/404, 448, 437, 439

[56] References Cited

U.S. PATENT DOCUMENTS

| | | | |
|---|---|---|---|
| 2,319,621 | 5/1943 | Mc Laughlin | 362/439 |
| 4,104,713 | 8/1978 | Chan et al. | 362/294 |
| 4,234,916 | 11/1980 | Goralnik | 362/294 |
| 4,507,719 | 3/1985 | Quiogue | 362/404 |
| 4,661,885 | 4/1987 | Brenner et al. | 362/448 |

*Primary Examiner*—Carroll B. Dority

*Attorney, Agent, or Firm*—Kane,Dalsimer,Sullivan,Kurucz,Levy,Eisele and Richard, LLP

[57] ABSTRACT

A lighting fixture with a socket base having a closed and cool running back which reduces the amount of heat transferred to the area behind the lamp socket base and allows lower temperature rated wires to be used in the installation of the lamp socket base. The lamp socket base has raised lugs on which the lamp socket rests. A gasket is placed around or between the lamp socket and the lamp socket base and another gasket is placed between the lamp socket base and the wall or ceiling box. The lamp socket base is constructed as one piece such as from a casting. All of these features help to reduce the amount of heat transferred from the lamp socket to the other side of the lamp socket base and also to the wires in the area behind the lamp socket base.

5 Claims, 3 Drawing Sheets

LIGHTING FIXTURE WITH A SOCKET BASE HAVING A CLOSED AND COOL RUNNING BACK

BACKGROUND OF THE INVENTION

1. Field of the Invention

The present invention pertains to a lighting fixture whose lamp socket base reduces the amount of heat transferred to the back of the base from the lamp and socket.

2. Description of the Prior Art

Lighting fixtures which have an industrial look, have become popular in a variety of environments. For example, a lighting fixture which has a bullet shaped glass globe covered by a bullet shaped cage like cover are found in industrial as well as residential installations. This type of lighting fixture is very popular even though problems have been encountered while installing the present designs of these lighting fixtures.

The lamp and lamp socket in a light fixture always generate heat which must be accounted for in the lighting fixture design. Prior bullet shaped lighting fixture designs have a base that holds the lamp socket but does not cover the back of the lamp socket since the lamp socket sticks through the base into the area behind the base. Thus, when the light is on, the back of the lamp socket will heat up the area behind the base. Since the base is usually screwed into an electrical box on the wall, the box including any wires in the box will also be heated. Some fixture designs place a cork casket between the back of the base and the electrical box in the wall or ceiling to try and reduce the amount of heat transmitted into the area behind the base. All of these prior designs, however, only reduce the maximum temperature behind the base to about 125 degrees Celsius. Thus, anything behind the base, such as the electrical box in the wall or ceiling or the wires, must be able to withstand temperatures up to 125 degrees Celsius.

Wires used in lighting fixtures and electrical boxes are rated according to the temperature that the wire can withstand before the wire fails. Since the ambient temperature behind the base of the previous bullet shaped fixture designs is around 125 degrees Celsius, the wires leading from the lamp socket to the electrical supply wires must be rated to withstand temperatures up to 125 degrees Celsius.

Most lighting fixture installers and contractors encounter a wiring problem due to the 125 degrees Celsius rated wire requirement. Installers and contractors usually do not look at what wire temperature rating is required to install a fixture until he is actually installing the fixture. Wires rated at 125 degrees Celsius are specialty wires and are not commonly found at a job site. Most installers and contractors will carry 90 degree Celsius rated wire since this wire is more commonly used. So when an installer or contractor realizes he needs 125 degree Celsius rated wire, the installer or contractor must go back to his truck or even go to a supply house to obtain the correct wire for use in the electrical box in the wall or ceiling.

Therefore, in order to alleviate these problems, an objective of the present invention is to provide a lighting fixture with a socket base having a closed and cool running back which reduces the amount of heat transmitted by the lamp socket to the area behind the lamp socket base and also to the electrical wires behind the lamp socket base.

Another objective of the present invention is to provide a lighting fixture with a socket base having a closed and cool running back where the lamp socket is secured to one side of the socket base and does not extend through the socket base to reduce the amount of heat transmitted from the lamp socket to the lamp socket base and also to the area behind the lamp socket base.

Another objective of the present invention is to provide a lighting fixture with a socket base having a closed and cool running back which allows wire with a rating as low as 90 degree Celsius to be used to connect the lamp socket to the electrical power lines in a wall or ceiling.

Another objective of the present invention is to provide a lighting fixture with a socket base having a closed and cool running back where the lamp socket rests on raised lugs inside the lamp socket base to further reduce the amount of heat transmitted from the lamp socket to the lamp socket base and also to the area behind the lamp socket base.

Another objective of the present invention is to provide a lighting fixture with a socket base having a closed and cool running back where gaskets are placed around or between the lamp socket and the lamp socket base and between the lamp socket base and whatever the lamp socket base will be mounted on, such as an electrical box in a wall, to further reduce the amount of heat transmitted from the lamp socket to the area behind the lamp socket base.

Another objective of the present invention is to provide a lighting fixture with a socket base having a closed and cool running back where the lamp socket base is one piece and not constructed of many parts to further reduce the amount of heat transmitted from the lamp socket to the area behind the lamp socket base.

SUMMARY OF THE INVENTION

The above and other beneficial objectives are obtained in accordance with the present invention by providing a lighting fixture with a socket base having a closed and cool running back. The lamp socket base has raised lugs on which the lamp socket rests. A gasket is placed around or between the lamp socket and the lamp socket base and another gasket is placed between the lamp socket base and the wall or ceiling box. The lamp socket base is constructed as one piece such as from a casting. All of these features help to reduce the amount of heat transferred from the lamp socket to the other side of the lamp socket base and also to the wires in the area behind the lamp socket base.

DETAILED DESCRIPTION OF THE PREFERRED EMBODIMENTS

The aforementioned figures illustrate a lighting fixture with a socket base having a closed and cool running back 10 where identical numerals in each figure represent identical elements.

Figure 1:
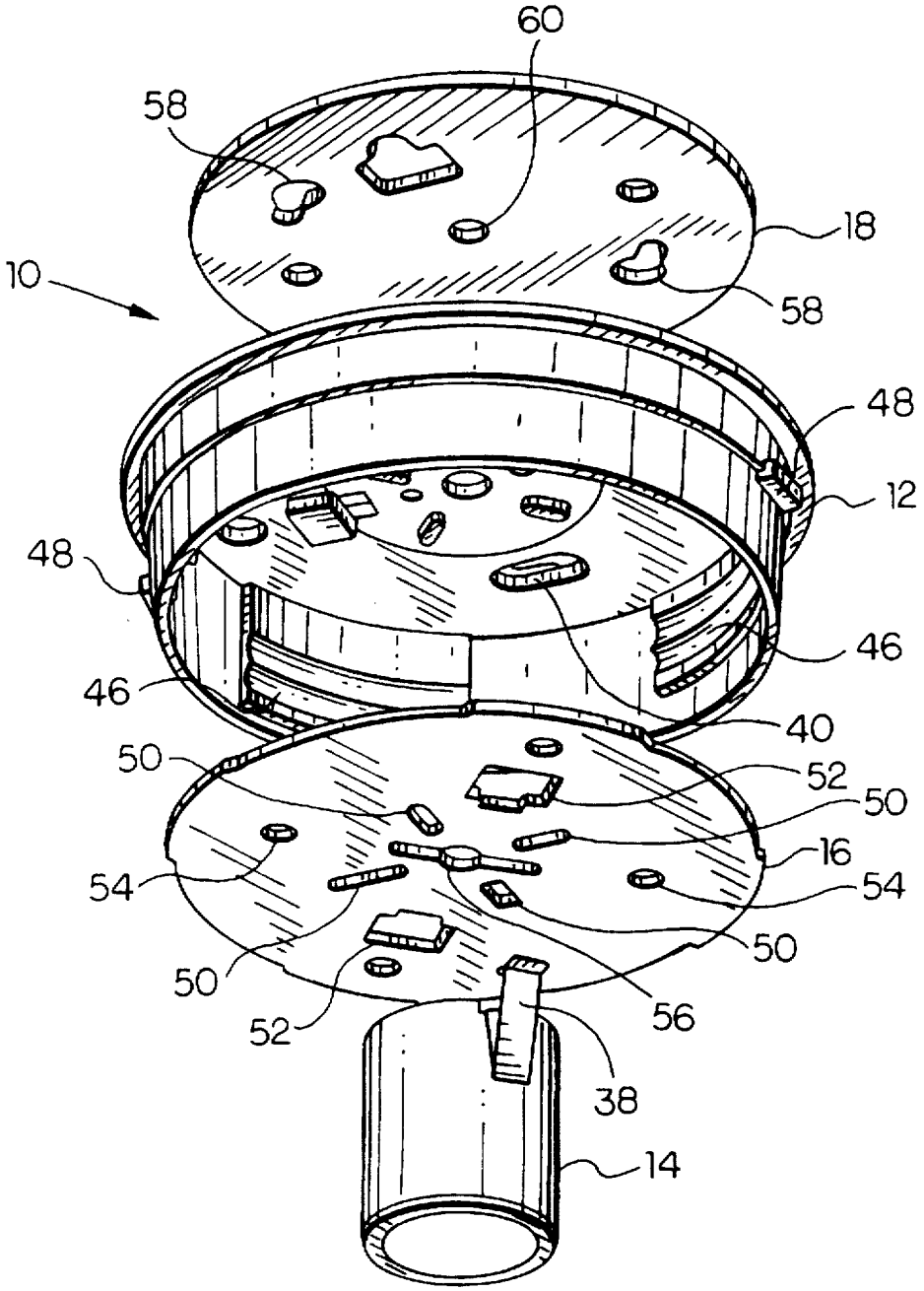
FIG. 1 is an exploded view of a lighting fixture with a socket base having a closed and cool running back.

As shown in FIG. 1, a lighting fixture with a socket base having a closed and cool running back 10 basically consists of lamp socket base 12, lamp socket 14 and heat insulating gaskets 16 and 18. Lamp socket base 12 is further illustrated in FIG. 2. Lamp socket base 12 is a one-piece unit composed of a circular plate part 20 and a tubular part 22.

Circular plate part 20 of lamp socket base 12 is adapted to hold lamp socket 14 and to hold the mounting screws (not shown) that hold lamp socket base 12 against a wall or ceiling or another fixture component such as a ballast housing. Circular plate part 20 has a lamp socket mounting surface 24 and a back surface 26. Lamp socket mounting surface 24 has center hole 28 through which wires (not shown) pass from lamp socket 14 to the region behind lamp socket base 12.

Figure 2:
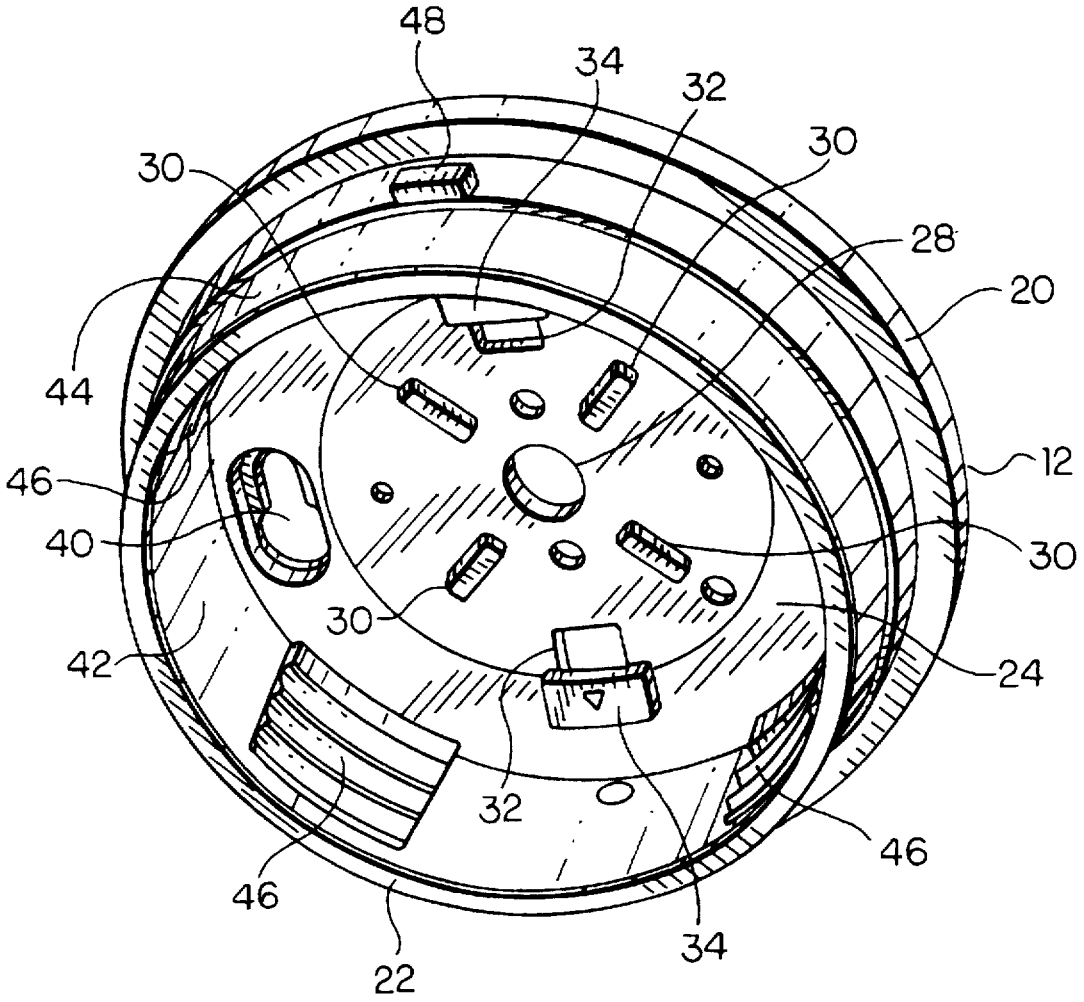
FIG. 2 illustrates the lamp socket base.

Lamp socket mounting surface 24 has a plurality of lugs that space lamp socket 14 away from lamp socket mounting surface 24. As shown in FIG. 2, lamp socket mounting surface 24 has four lugs 30 evenly positioned around center hole 28. Lugs 30 support lamp socket 14 and prevent lamp socket 14 from resting on lamp socket mounting surface 24 when lamp socket 14 is installed into lamp socket base 12.

Lamp socket mounting surface 24 has two cutouts 32 placed on opposite sides of center hole 28. Cutouts 32 are partially covered by covers 34 in order to receive and hold tab 36 and spring tab 38 of lamp socket 14 when lamp socket 14 is installed into lamp socket base 12.

Lamp socket mounting surface 24 has two keyways 40 placed on opposite sides of center hole 28. Keyways 40 extend along the same circumference of circular plate part 20. When keyways 40 are placed over mounting screws (not shown) and lamp socket base 12 is rotated, keyways 40 will engage the heads of the mounting screws and prevent lamp socket base 12 from falling off the wall or ceiling or other fixture component.

Tubular part 22 is a ring with inner side wall 42 and outer side wall 44. Four sets of screw threads 46 are evenly spaced around inner side wall 42. Screw threads 46 engage corresponding screw threads on a glass globe (not shown) to hold the glass globe in lamp socket base 12. Two bayonets 48 are on outer side wall 44 on opposite sides of tubular part 22. Bayonets 48 engage two keyways in a guard (not shown) to hold the guard on lamp socket base 12.

Two heat insulating gaskets 16, 18 are placed on either side of circular plate part 20. Heat insulating gasket 16 is placed inside lamp socket base 12. Gasket 16 has several cutouts to allow gasket 16 to lie flush against lamp socket mounting surface 24. Cutouts 50 allow gasket 16 to fit over lugs 30. Cutouts 50 allow gasket 16 to fit over covers 34 and, also, allow access to cutouts 32 for tab 36 and spring tab 38 of lamp socket 14. Cutouts 52 allow access to keyways 40 so one can tighten the mounting screws (not shown) engaged by keyways 40 when lamp socket base 12 is mounted on a wall or ceiling or another fixture component. Finally, cutout 56 allows the wires (not shown) from lamp socket 14 to be inserted through center hole 28. In addition, the shape of cutout 56 allows the wires (not shown) from lamp socket 14 to lie flush against lamp socket mounting surface 24 so that lamp socket 14 can rest against lugs 30 without any interference.

Heat insulating gasket 18 is placed between back surface 26 of circular plate art 20 and a wall or ceiling or another fixture component when lamp socket base 12 is installed against a wall or ceiling or another fixture component. Gasket 18 also has various cutouts to allow gasket 18 to lie flush against back surface 26 and the wall, ceiling or fixture component. Cutouts 58 allow the heads of the mounting screws (not shown) in the wall, ceiling or fixture component to fit into keyways 40 and allows keyways 40 to slide over the heads of the screws. Cutout 60 allows the wires (not shown) from lamp socket 14 to pass through from center hole 28 to the area behind lamp socket base 14 which is usually the space within an electrical box in the wall or ceiling or an area in the fixture component.

Figure 3:
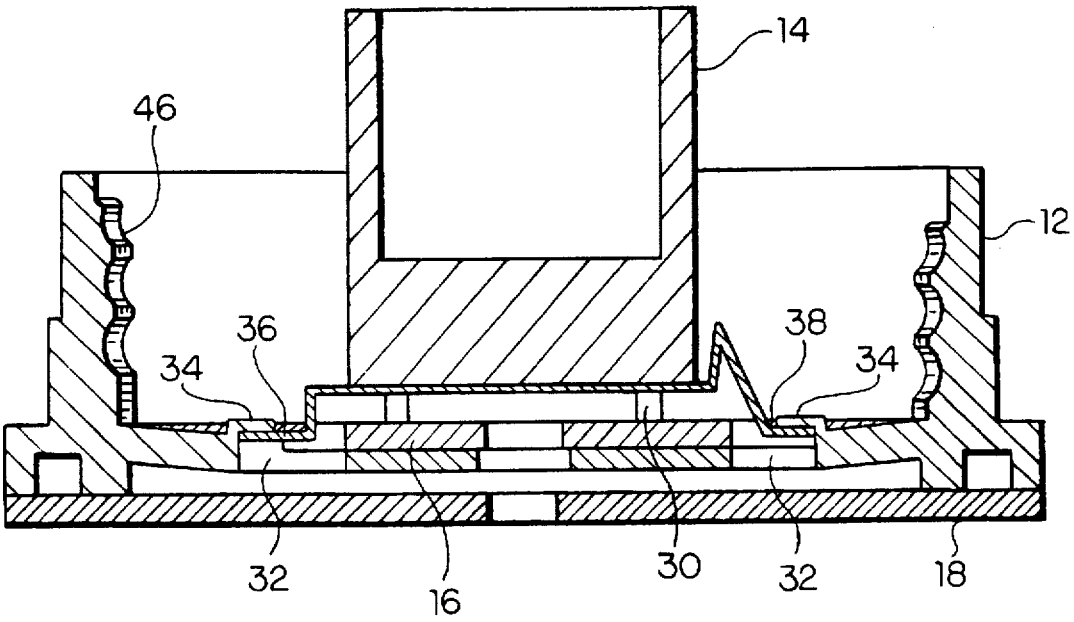
FIG. 3 is a cross sectional view of an assembled lighting fixture with a socket base having a closed and cool running back.

FIG. 3 is a cross-sectional view of the various parts of the lighting fixture with a socket base having a closed and cool running back 10 assembled before lamp socket base 12 is placed against a wall or ceiling. To assemble the present invention, heat insulating gasket 16 is first placed into lamp socket base 12 and against lamp socket mounting surface 24 so that all the cutouts in gasket 16 are placed over the correct parts of lamp socket mounting surface 24.

Next, lamp sock 14 is installed in lamp socket base 12. The wires (not shown) of lamp socket 14 are inserted through cutout 56 of gasket 16 and center hole 28 of circular plate part 20. Tab 36 of lamp socket 14 is placed into one of the cutouts 32 in lamp socket mounting surface 24 and under the corresponding cover 34. As lamp socket 14 is brought down to rest on lugs 30 and gasket 16, the wires (not shown) of lamp socket 14 are pushed through cutout 56 center hole 28 and down into cutout 56. The wires are positioned to rest against lamp socket mounting surface 24 so as to interfere with lamp socket 14 resting on lugs 30 and heat insulating gasket 16. Spring tab 38 is squeezed into the other cutout 32 and under the corresponding cover 34.

Heat insulating gasket 18 is then placed against back surface 26. After pushing the wires (not shown) of lamp socket 14 through cutout 60 of gasket 18, gasket 18 is positioned against back surface 26 so that cutouts 58 of gasket 18 line up with keyways 40.

Finally, the assembled lighting fixture with a socket base having a closed cool running back 10 is installed onto a wall, ceiling or fixture component. First, the wires (not shown) from socket 14 are connected to the other lead wires (not shown) the wall, ceiling or fixture component. Then, two mounting are inserted into an electrical box in the wall or ceiling into the fixture component. The assembly is placed so that tile two mounting screws (not shown) fit into keyways 40. Then, the assembly is rotated so that the keyways 40 slide over and engage the heads of the mounting screws (not shown). Then, the mounting screws (not shown) are tightened so that the lighting fixture with a socket base having a closed and cool running back 10 is held against the wall, ceiling or fixture component. Then, tile other parts of the light fixture such as a light bulb, the glass globe and the guard can be installed.

During operation of the light, the present invention will prevent the area behind lamp socket base 12, which usually is the area in the electrical box or the area in the other fixture component, from reaching elevated temperatures. When a light in lamp socket 14 is on, the light will generate a lot of heat some of which is transmitted through lamp socket 14. Lamp socket 14 is raised up off of lamp socket mounting surface 24 by lugs 30. This construction allows more heat from lamp socket 14 to be absorbed by and carried away by the air circulating around lamp socket 14 and, thus, helps to prevent all of the heat generated by lamp socket 14 from being transmitted to the area behind lamp socket base 12. In addition, heat insulating gaskets 16, 18, preferably made of silicone, help to reduce the amount of heat transmitted to the area behind lamp socket base 12 by acting as insulators. The lamp socket base 12 is usually of one piece construction, such as a casting made of aluminum, which helps lamp socket base 12 to better disperse any heat absorbed from lamp socket 14 into the ambient environment.

These features (i.e., lugs 30; gaskets 16, 18; and the one piece socket base 12) work together to reduce the amount of heat transmitted to the area behind lamp socket base 12.

Each of these features, however, works independently of the other and, thus, one of the features could be used without the others to reduce the amount of heat transmitted. For example, the heat insulating gaskets 16 could be used without the lugs 30. In this case, gasket 16 would overly lamp socket mounting surface 24 and would either surround lamp socket 14 as socket 14 rests on lamp socket mounting surface 14 or support lamp socket 14 as socket 14 rests on gasket 16.

Thus, the aforementioned objectives are effectively attained. Although a single preferred embodiment of the invention has been disclosed and described in detail above, one should easily understand that the scope of this invention is in no sense limited by this disclosure but is determined by the appended claims.

We claim:

1. A lighting fixture comprising:

a lamp socket;

a lamp socket base having an integral circular plate, said integral circular plate having a mounting surface and a back surface;

complementary means on said lamp socket base and lamp socket for securing said lamp socket to said mounting surface with no portion of said lamp socket extending to said back surface; and a plurality of lugs extending from said mounting surface for spacing said lamp socket apart from said mounting surface.

2. The lamp fixture in accordance with claim 1 wherein said plurality of lugs comprises four lugs evenly spaced about a center.

3. A lighting fixture, comprising:

a lamp socket;

a lamp socket base having an integral circular plate, said integral circular plate having a mounting surface and a back surface;

complementary means on said lamp socket base and lamp socket for securing said lamp socket to said mounting surface with no portion of said lamp socket extending to said back surface; and a heat insulating gasket having a portion overlying said mounting surface and surrounding said socket;

wherein said heat insulating gasket sits on said mounting surface and includes a first plurality of cutouts aligned with a plurality of lugs extending from said mounting surface, said plurality of lugs passing through said first plurality of cutouts, said lamp socket sitting on said lugs and said gasket.

4. The lamp fixture in accordance with claim 3 further comprising a second heat insulating gasket disposed against said socket base back surface.

5. The lamp fixture in accordance with claim 3 further comprising a second plurality of cutouts in said gasket, said second plurality of cutouts being aligned with said complementary securing means on said socket and base to permit said securing means to pass through said gasket.

* * * * *